US007610926B2

(12) United States Patent
Adams

(10) Patent No.: US 7,610,926 B2
(45) Date of Patent: Nov. 3, 2009

(54) MOBILITY DEVICE

(75) Inventor: Michael E. Adams, Chicago, IL (US)

(73) Assignee: StrongArm Inc., Lake Bluff, IL (US)

( * ) Notice: Subject to any disclaimer, the term of this patent is extended or adjusted under 35 U.S.C. 154(b) by 52 days.

(21) Appl. No.: 11/804,286

(22) Filed: May 17, 2007

(65) Prior Publication Data

US 2008/0006314 A1 Jan. 10, 2008

Related U.S. Application Data

(63) Continuation-in-part of application No. 29/259,942, filed on May 17, 2006, now abandoned, and a continuation-in-part of application No. 29/259,943, filed on May 17, 2006, now abandoned, and a continuation-in-part of application No. 29/259,951, filed on May 17, 2006, now abandoned.

(51) Int. Cl.
*A61H 3/02* (2006.01)

(52) U.S. Cl. ..... 135/71; 135/72; 135/84

(58) Field of Classification Search ..... 135/71, 135/73, 68
See application file for complete search history.

(56) References Cited

U.S. PATENT DOCUMENTS

| | | | |
|---|---|---|---|
| 127,028 | A | 5/1872 | Crandall |
| 267,680 | A | 11/1882 | Crandall |
| 2,597,400 | A | 5/1952 | Stogsdill, et al. |
| 2,645,874 | A | 7/1953 | Collins |
| 3,223,383 | A | 12/1965 | Hrabal |
| 3,301,268 | A | 1/1967 | Tryon |
| D239,011 | S | 3/1976 | Hamasaka |
| 4,044,784 | A | 8/1977 | Smith |
| 4,086,932 | A | 5/1978 | Richardson |
| 4,094,391 | A | 6/1978 | Ratchford |
| 4,364,592 | A | 12/1982 | Jackson |
| 4,660,875 | A | 4/1987 | Ziegler |
| 4,691,954 | A | 9/1987 | Shaud |
| 4,787,405 | A | 11/1988 | Karwoski |

(Continued)

OTHER PUBLICATIONS

Clinic Products/Exercise Catalog for Step Stretch® Ankle Exerciser, p. 193 (undated).

(Continued)

*Primary Examiner*—David Dunn
*Assistant Examiner*—Danielle Jackson
(74) *Attorney, Agent, or Firm*—Fitch, Even, Tabin & Flannery

(57) ABSTRACT

A mobility device to provide ambulatory support includes a tubular body having upper and lower parts. The upper part has at least four, and preferably five, bends and includes a manually graspable handle portion between two of the bends, and a hook-shaped bend for engaging the user's forearm on three sides adjacent the elbow. An intermediate portion including another bend is positioned between two other bends, and is positioned between the handle portion and the bend located adjacent the user's elbow. The lower part includes a floor-engaging free end and defines an axis, preferably a generally vertical axis. The bends and other features of the upper part cooperate to provide improved support for a user's forearm. Also disclosed is a rocker-type end member either fixedly or slidably fitted to the lower part.

29 Claims, 10 Drawing Sheets

U.S. PATENT DOCUMENTS

| | | | | | |
|---|---|---|---|---|---|
| 4,865,373 | A | | 9/1989 | Hudson | |
| 4,899,771 | A | | 2/1990 | Wilkinson | |
| 5,103,850 | A | | 4/1992 | Davis | |
| 5,156,429 | A | * | 10/1992 | Adams | 294/25 |
| 5,193,567 | A | * | 3/1993 | Razny, Jr. | 135/68 |
| 5,301,703 | A | | 4/1994 | Kahn | |
| 5,301,704 | A | | 4/1994 | Brown | |
| 5,335,683 | A | | 8/1994 | Ledley | |
| 5,353,825 | A | | 10/1994 | Davis | |
| 5,445,424 | A | | 8/1995 | Binette | |
| 5,495,867 | A | * | 3/1996 | Block | 135/65 |
| 5,832,563 | A | | 11/1998 | Simpson | |
| D407,571 | S | | 4/1999 | Parmar | |
| 6,037,167 | A | | 3/2000 | Adelman et al. | |
| D457,414 | S | | 5/2002 | Spangmyr et al. | |
| D468,910 | S | | 1/2003 | Carman, Jr. et al. | |
| D468,911 | S | | 1/2003 | Carman, Jr. et al. | |
| D513,218 | S | | 12/2005 | Fitzgerald | |

OTHER PUBLICATIONS

PCT/US2008/063928 International Search Report.

* cited by examiner

MOBILITY DEVICE

CROSS-REFERENCE TO RELATED APPLICATIONS

This application is a continuation-in-part of U.S. Design patent application Ser. Nos. 29/259,942 filed May 17, 2006, now abandoned, 29/259,943 filed May 17, 2006 now abandoned and 29/259,951 filed May 17, 2006 now abandoned.

FIELD OF THE INVENTION

The present invention relates to arrangements for providing ambulatory support, such as canes, crutches and the like.

BACKGROUND OF THE INVENTION

Mobility devices, such as ambulatory aids assist a user in pedestrian activities such as walking, climbing and descending stairs, and related activities, where a user moves from place to place on foot. Two basic types of mobility devices include canes and crutches. Both of these types of mobility devices are loaded with a compressive strain when relied upon by the user to support all or a portion of a user's weight.

Disabilities suffered by different parts of the body can cause difficulties in walking, climbing stairs and otherwise negotiating impediments to foot traffic encountered in a modern lifestyle. A wide variety of disabilities, whether temporary or longer lasting, can significantly impair a person's ability to acquire and maintain stability, whether at rest or in motion. While some physical conditions may be temporary, lasting only certain parts of the day or for a defined period of time such as a few weeks or months, more permanent disabilities cause a drastic change in lifestyle, requiring a person to develop new coping skills. Oftentimes, throughout an adaptation process, progress is slow and one set of physical problems and limitations are often substituted for, or augmented by, another.

One particular challenge presented to disabled individuals is the ability to independently negotiate environments designed for those that are relatively healthy. Constructions of sidewalks, building passageways and a wide variety of public and private places assume that an individual will be able to readily negotiate building features as a person walks from one place to another. For example, individuals are expected to be able to negotiate not only long flights of stairs but also ramps, curbs, slopes and escalators. Persons who experience a certain amount of debilitation leading to impairment of their ability to walk and climb, are faced with new challenges if they expect to remain independently mobile. In the past, there have been a wide variety of walking aids such as canes, forearm and underarm crutches and wheeled-support devices to assist individuals in this regard. One line of products which should receive immediate user acceptance are those about to be offered by STRONGARM Inc., assignee of the present invention.

Several difficulties have been encountered over the years, by users of walking aid devices. While a relatively healthy individual suffering from a brief medical setback may more readily adapt to canes and other mobility support devices, users having long-term disabilities are less able to cope with compromises in mobility device designs. It is well-known, for example, that when one part of the body weakens, the loads and stresses previously borne by that part of the body are distributed to other body parts. Oftentimes, individuals with long-term disabilities are not able to distribute such loads as effectively as healthy individuals. Problems therefore arise with individuals who are less able to distribute forces from one body part to another. It has been found that the designs of mobility devices must accommodate heightened sensitivities of individuals who are at greater physical risk. It is imperative that such physical risk be minimized and the individual rendered more comfortable, if independent mobility is to be retained.

Accordingly, improvements in mobility devices are constantly being sought. Desirable improvements for example would include the ability to achieve and thereafter maintain day-long stability whether walking or standing inactive.

The need for providing mobility devices with improved support characteristics will be met by a mobility device commercially available under the trade designation "STRONGARM Support Cane," soon to be offered for sale by the assignee of the present invention. This mobility device includes a tubular body with a plurality of bends for engaging a user's forearm while providing a graspable handle and a lower portion with a tip for engaging a floor, parking lot or other support surface. Despite the substantial improvements offered by the STRONGARM Support Cane, further advances, particularly in user-perceived support, stability and control are being sought.

In a separate field of endeavor, utility handles have been proposed for a variety of purposes, such as lifting or supporting a power tool or a tool which is manually operated, such as a shovel or rake. U.S. Pat. No. 5,156,429, by the inventor of the present invention provides a utility handle including a tubular body with bends for engaging a user's forearm and a handle graspable by the user. The utility handle is useful for lifting or otherwise supporting portable objects in a raised position, but is not configured to effectively support a user's weight, as with a crutch or cane.

SUMMARY OF THE INVENTION

In one example, the present invention provides a novel and improved mobility device which includes a tubular body having an upper part and a lower part. The lower part includes a floor-engaging free end and defines an axis which, preferably, is generally vertical. The upper part has at least four, and preferably five bends, comprising an upper arm retainer providing lateral as well as rearward support, a manually graspable handle portion, and an intermediate portion. Together, the bends and portions of the upper part confine a user's forearm to a vertical plane that is generally aligned with the axis of the lower part and is only slightly offset therefrom when viewed from the side.

In one embodiment, the manually graspable handle portion is oriented exclusively along a straight line which, preferably, is generally horizontal and the user's weight is placed over the lower part. The manually graspable handle portion can include a cushion which restricts the user's grasp to the handle portion, rather than allowing the user to grasp adjacent bends. The mobility device may be either fixed in length or adjustable, with the upper and lower parts telescopically engaging one with the other.

In one embodiment, an end member is located at the free end of the floor-engaging end of the lower part. The end member supports the mobility device with a rocking action as the user is in motion, either walking or climbing, for example. The end member has a ground-engaging surface which, preferably, is continuously rounded and which has a convex surface facing the ground.

In another example, the present invention provides a novel and improved mobility device which includes a tubular body having an upper part and a lower part. The lower part includes a floor-engaging free end and defines an axis which, preferably, is generally vertical. The upper part has at least five bends, preferably planar, that is, single plane, not compound. One bend comprises an upper arm retainer, and a manually graspable handle portion is disposed between two other of said bends. The manually graspable handle portion is disposed above, and intersects the axis of the lower part. A pair of bends on either side of said handle portion orient the handle portion in a generally horizontal direction and one of the bends comprises an alignment bend aligning the first and the second axes.

In a further example, the present invention provides a novel and improved mobility device which includes a tubular body having an upper part and a lower part. The lower part includes a floor-engaging free end and defines an axis which, preferably, is generally vertical. The upper part has at least five bends defining a vertical plane, with one of the bends engaging the back and both sides of the user's forearm. The upper part includes a manually graspable handle portion disposed between two of said bends, and the lower part defines an axis in the vertical plane. The bends cooperate to orient an axis of the user's forearm in substantial alignment with the vertical plane.

BRIEF DESCRIPTION OF THE DRAWINGS

In the drawings, which comprise a portion of this disclosure.

DESCRIPTION OF THE PREFERRED EMBODIMENTS

Figure 1:
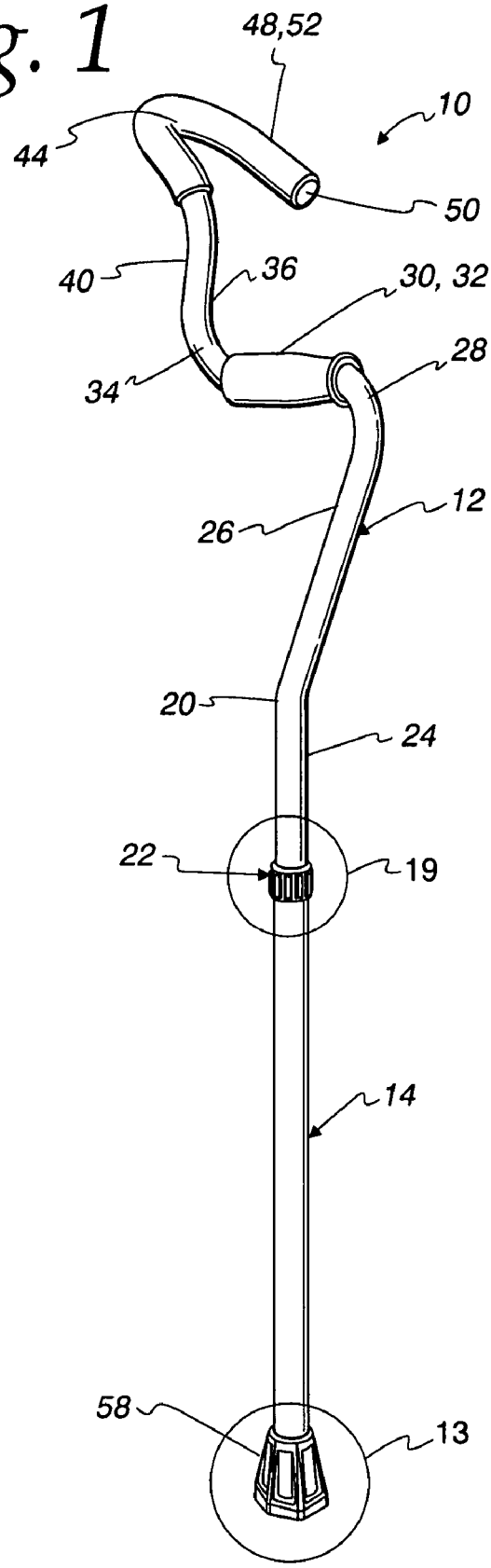
FIG. 1 is a perspective view of a mobility device having a length adjustment feature.
Figure 2:
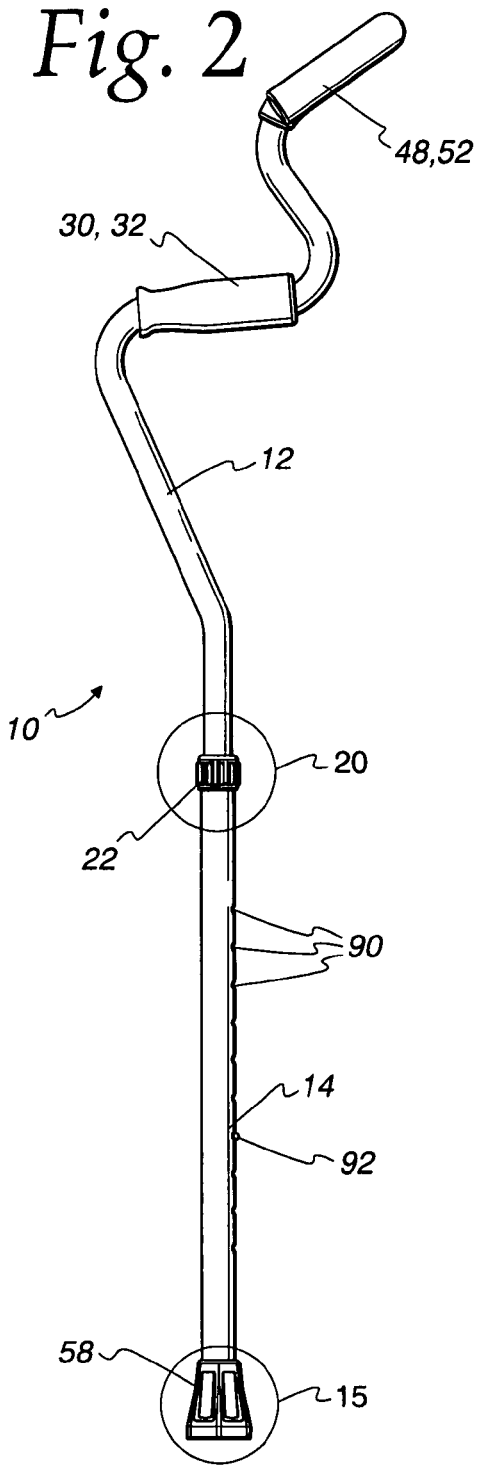
FIG. 2 is a side elevational view from one side thereof.
Figure 3:
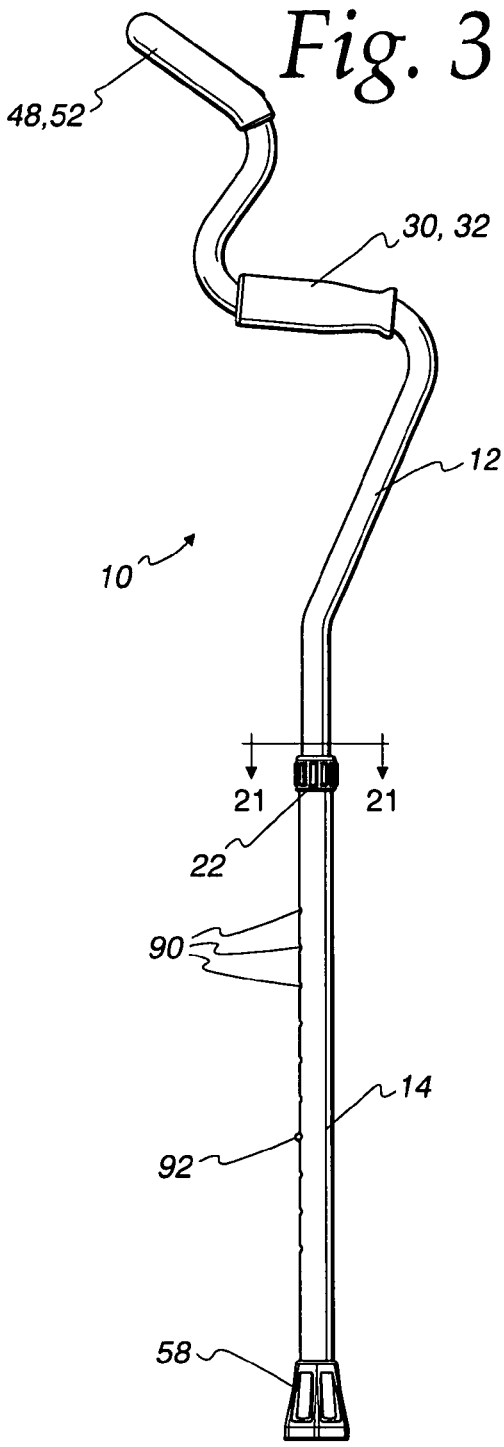
FIG. 3 is a side elevational view from the opposite side thereof.

The invention disclosed herein is, of course, subject to many possible embodiments. Shown in the drawings and described below in detail are preferred embodiments of the invention. It is to be understood, however, that the present disclosure is an exemplification of the principles of the invention and does not limit the invention to the illustrated embodiments.

For ease of description, mobility devices embodying the present invention are described herein in their usual assembled position as shown in the accompanying drawings, and terms such as upper, lower, horizontal, longitudinal, etc. may be used herein with reference to their usual position. However, the mobility devices may be manufactured, transported, sold or used in orientations other than that described and shown herein.

Referring now to the drawings, and initially to FIGS. 1-7, a mobility device is generally indicated at 10. Included is a tubular body having an upper portion 12 and a lower portion 14. Body portions 12, 14 are preferably formed from one-piece hollow metallic tubing such as aluminum and most preferably "aircraft grade" aluminum. For example, 6000 series alloys have been found to undergo substantial "work hardening" after forming bends of the type described herein. This work hardening provides a substantial increase in strength for the upper body member 12, providing an enhanced feeling of stability and alignment of a user's forearm with the lower body part 14. If desired, other types of metallic and non-metallic materials could be used, as well. Preferably, body portions 12, 14 are telescopically interfittable, one within the other. In the illustrated embodiment, upper body part 12 is fitted within lower body part 14 and recesses generally to a point adjacent the bottom free end of lower body part 14, thus exhibiting maximum shortening adjustment.

As can be seen in FIGS. 1-7, upper body part 12 is formed with a number of bends. In the illustrated embodiment, upper body part 12 is provided with five bends although other numbers of bends could be employed as well. The bends are preferably planar, that is, single plane bends, and not compound bends. Starting at the bottom of the exposed portion of upper body part 12, a first bend 20 is located adjacent a locking collar or locking nut 22 mounted to the upper end of body part 14. Bend 20 is located between a lower portion 24 of body part 12 (see FIG. 1) and a riser portion 26.

A second bend 28 is located between riser portion 26 and a handle portion 30 covered by a hand grip cushion 32. Cushion 32 may be made from any suitable material such as rubber or a plastic composition in either solid, open cell or closed cell form. Preferably, cushion 32 is extruded or molded so as to take on a generally cylindrical form, but cushion 32 could also comprise a tape wrapping.

A third bend 34 is formed between the handle portion 30 and an intermediate portion 36 which includes a fourth bend 40.

A fifth bend 44 forms a generally U-shaped rounded receptacle or retainer portion 48 located at the upper free end of body part 12. Bend 44 is dimensioned to accommodate users in short sleeve shirts as well as users wearing coats. At critical points during a step, when the user is off balance, considerable pressure may be applied by the user's triceps area at the back of the arm. If bend 44 were not large enough and smoothly rounded as in the preferred embodiment, pain experienced in the user's arm may cause the user to lighten pressure against the bend, thus compromising support as well as stability. The straight "legs" on either side of the fifth bend give the bend its "U" shape to provide both lateral and rearward stability to the user's forearm. In other words, the integral tubular forearm cradle of the present invention provides the user's forearm with solid support both to the rear and side-to-side.

Figure 4:
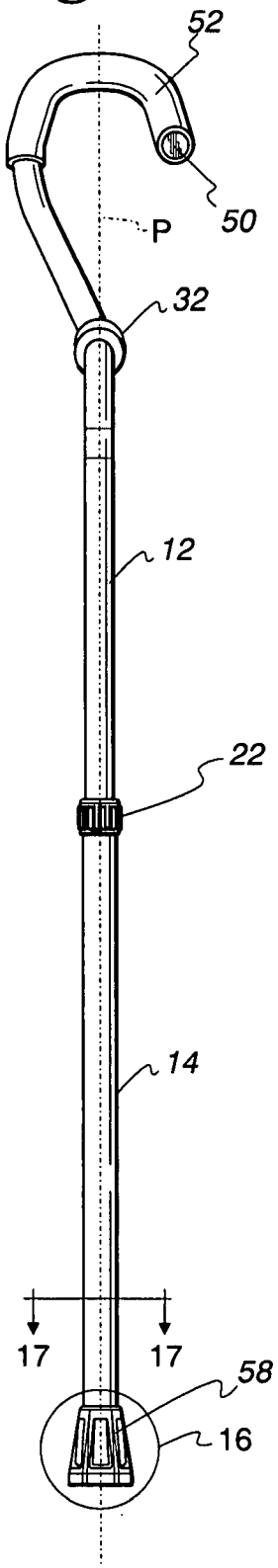
FIG. 4 is a front elevational view thereof.
Figure 5:
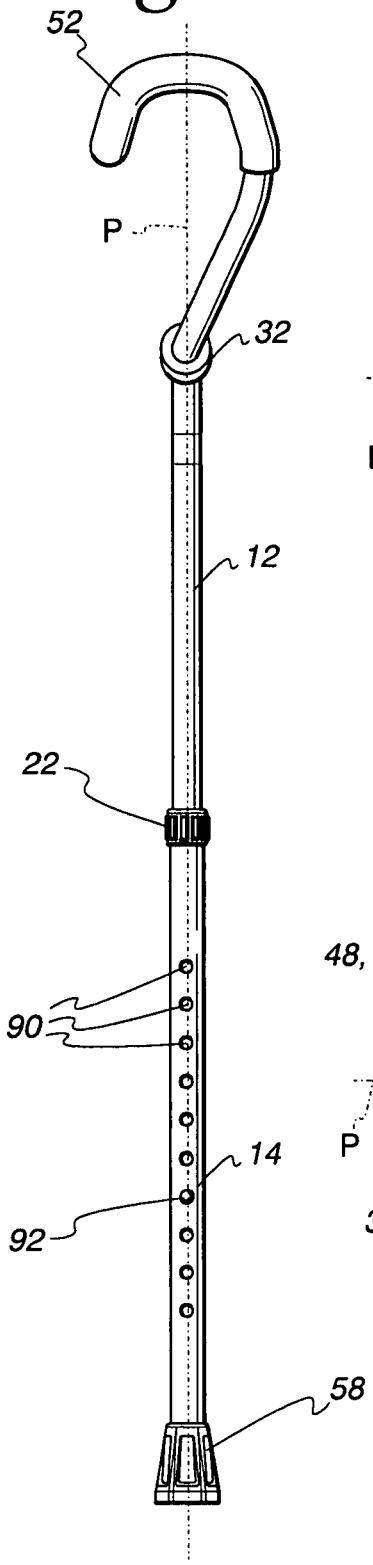
FIG. 5 is a rear elevational view thereof.

Referring additionally to the upper end of FIG. 4, an end cap 50 closes the open free end of body part 12. If desired, upper body part 12 can be formed of a solid material and accordingly end cap 50 can be omitted. A cushion 52 covers a "cradle", or retainer portion, 48. Cushion 52 is preferably made from a material similar to that of hand grip cushion 32, although virtually any available material can be employed, if desired. It should be understood that cushions 32, 52 are not necessary for functioning of the mobility device 10 although, when provided, they can significantly increase the user's comfort, and lead to increased confidence.

Figure 14:
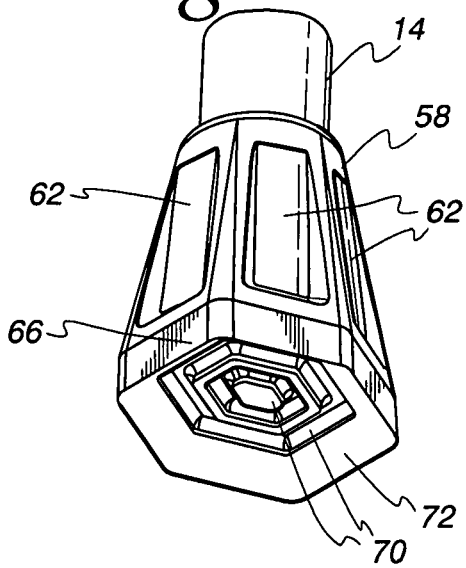
FIG. 14 shows the fragmentary portion of FIG. 13 taken from an upward looking perspective.
Figure 15:
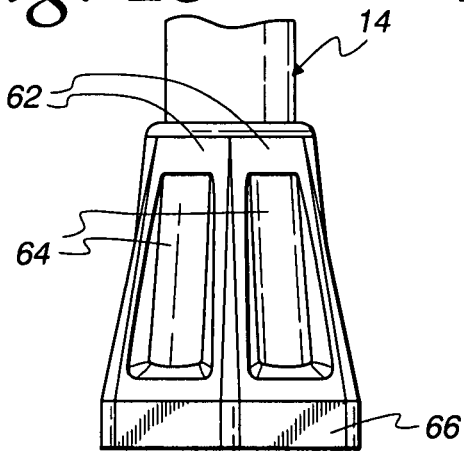
FIG. 15 is a fragmentary portion of the mobility device of FIG. 2, taken on enlarged scale.
Figure 16:
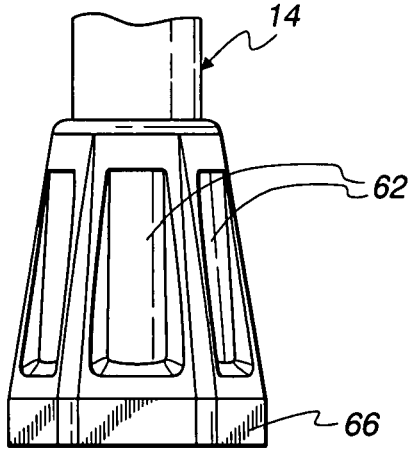
FIG. 16 is a fragmentary portion of the mobility device of FIG. 4, taken on an enlarged scale.
Figure 17:
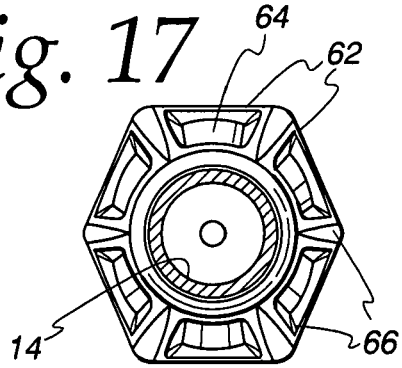
FIG. 17 is a cross-sectional view taken along the line 17-17 of FIG. 4.
Figure 18:
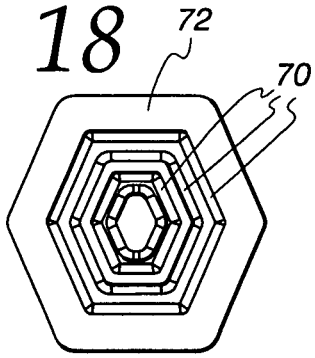
FIG. 18 is a fragmentary portion of the mobility device of FIG. 7, taken on enlarged scale.

Referring again to FIG. 1, lower body part 14 is preferably formed of hollow tubular material. As mentioned, locking nut 22 is provided at the upper end of body part 14 and as can be seen in the figures, an end piece indicated at 58 covers the bottom end of body part 14. End piece 58 may be made of rubber, or a plastics material. Preferably, end piece 58 is made from a molded elastomeric material which is solid in composition and semi-rigid in structure. End piece 58 is illustrated in greater detail in FIGS. 13-18. As can be seen in these Figures, end piece 58 preferably has a pseudo-frustoconical shape with six facets or side walls 62. Each side wall 62 includes a depressed panel 64 surrounded by an outstanding rib-like frame 66. As can be seen in FIG. 14, for example, the bottom of end piece 58 is concave and as can be seen in FIG. 18, is comprised of plurality of internested six-sided rings 70. A thickened outer band 72 (see FIG. 14) surrounds rings 70 and provides the principle point of contact with the ground, floor, pavement or other support surface on which mobility device 10 is used.

The above-described features cooperate together to form a unified system that provides heretofore unattainable advantages over prior art mobility devices. For example, the preferred one piece construction of upper body part 12 provides a sleek attractive form while avoiding joinder problems with more complex multi-component assemblies, or attendant arrangements such as those using large plastic "cuffs". The U-shaped retainer portion 48 provides a forearm-cradling support that solidly braces the forearm on three sides to stabilize a user's wrist so that the mobility device feels like a solid extension of the user's arm. With the bends and construction elements described herein, the retainer portion 48 has improved centering with respect to the line of force experienced by a user whether static or mobile, and insures a neutral wrist position for the same "feel" in either hand.

For example, when viewing a user from the side, the user's forearm is positioned more towards vertical than in prior designs, but while keeping the user's arm within a comfortable range of motion, so as to reliably transfer substantial body weight to device 10, when needed. Also, when viewing from the front (FIG. 4) or the rear (FIG. 5) the axis of the user's forearm is now aligned in the vertical plane P (defined by the bends and portions between the bends) that passes through body part 14 as well as the fifth bend covered by cushion 52 (see for example, plane P in FIGS. 6 and 7). With the present invention, the bends 28, 34 located at either ends of handle portion 30 are made with a relatively small radius, allowing a longer grip region in less space further contributing to force alignment in a sleek, more compact design. Further, with the present invention, the handle portion 30 is centered over the ground-engaging tip 58 to provide improved stability when the mobile device is placed at a user's side.

Together, the handle portion 30 and the retainer portion 48 shift loads from a user's wrist to the forearm, providing substantially improved support. Also, the retainer portion 48 cooperates with other features of the mobility device that tie lower shaft movements to a stabilized forearm, rather than transferring loads to an unsupported, flexible wrist joint. It is generally preferred in this regard that handle portion 30 be made straight, and removed from bend 28 so that a user is encouraged to avoid grasping bend 28 since that might compromise stability. Accordingly, the end of cushion 32 adjacent bend 28 is given a stop in the form of an hourglass shape (see for example the right-hand end of FIG. 6) to prevent a user's hand from slipping beyond, or inadvertently reaching past the handle portion 30.

Figure 19:
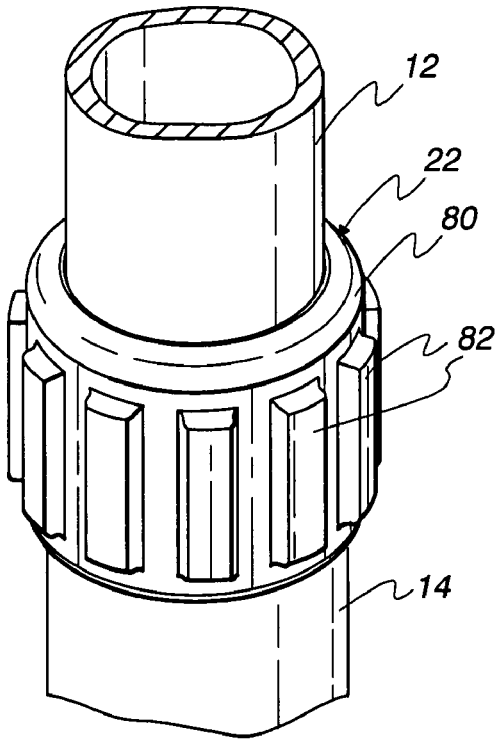
FIG. 19 shows a fragmentary portion of the mobility device of FIG. 1, taken on an enlarged scale.
Figure 20:
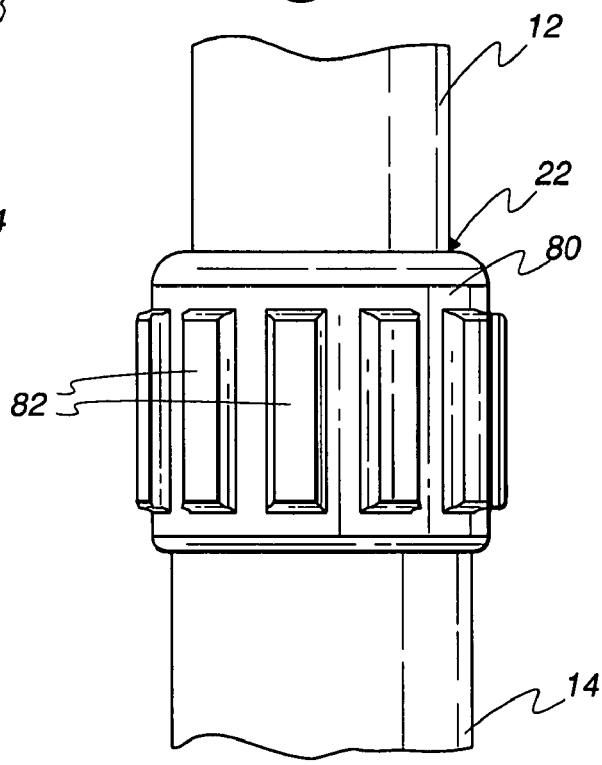
FIG. 20 is a fragmentary portion of the mobility device of FIG. 2, taken on an enlarged scale.
Figure 21:
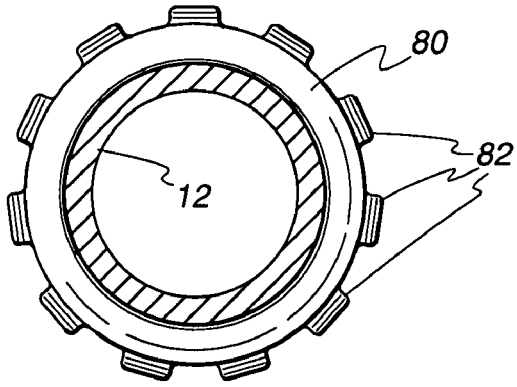
FIG. 21 is a fragmentary view taken along the line 21-21 of FIG. 3.

Turning now to FIGS. 19-21, locking collar 22 has a cylindrical body 80 and a plurality of raised ribs 82 extending generally parallel to the central longitudinal axis of lower body part 14. Locking nut 22 has internal threads which engage the upper free end of lower body part 14, which in cooperation with a split plastic bushing applies a compressive force to upper body part 12. Preferably, locking nut 22 provides secondary retention to hold body part 12 in a desired position with respect to lower body part 14. Referring to FIGS. 2-5, lower body part 14 includes a series of holes 90 spaced along its length. The lower end of body part 12 includes a conventional spring-loaded catch or detent 92 which is depressed as body part 12 is slid within body part 14. When the detent 92 is aligned with one of the holes 90, it protrudes through the hole, thereby securing body part 12 at a desired amount of insertion within body part 14. By depressing the detent 92, body part 12 can be slid to assume a new position within body part 14.

It is generally preferred that upper and lower body parts 12, 14, overlap as much as possible, to accommodate the largest number of users. It is also generally preferred that locking collar 22 be located adjacent the first bend 20. In the preferred embodiment, only approximately one-fourth of the length of the lower portion 24 is exposed at a setting of detent 92 that accommodates the largest number of users. For exceptionally tall users, it may be desirable to lengthen either lower portion 24 or lower part 14, or both, to provide increased overlap between upper and lower body parts 12, 14 than would otherwise be possible. Also, it is generally preferred that the telescoping end portions of upper and lower body parts 12, 14 be dimensioned for a relatively close tolerance fit, and that the cross-sectional shapes conform closely to one another, to further ensure a close tolerance telescopic engagement.

Figure 6:
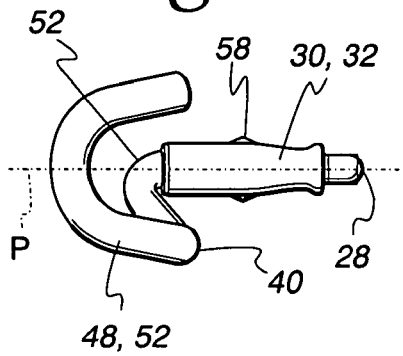
FIG. 6 is a top plan view thereof.
Figure 7:
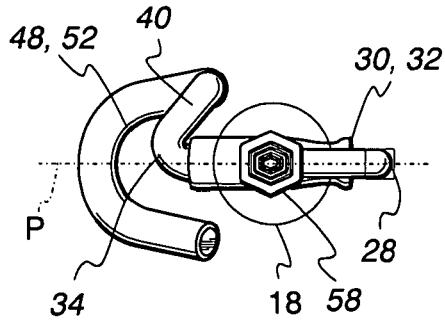
FIG. 7 is a bottom plan view thereof
Figure 8:
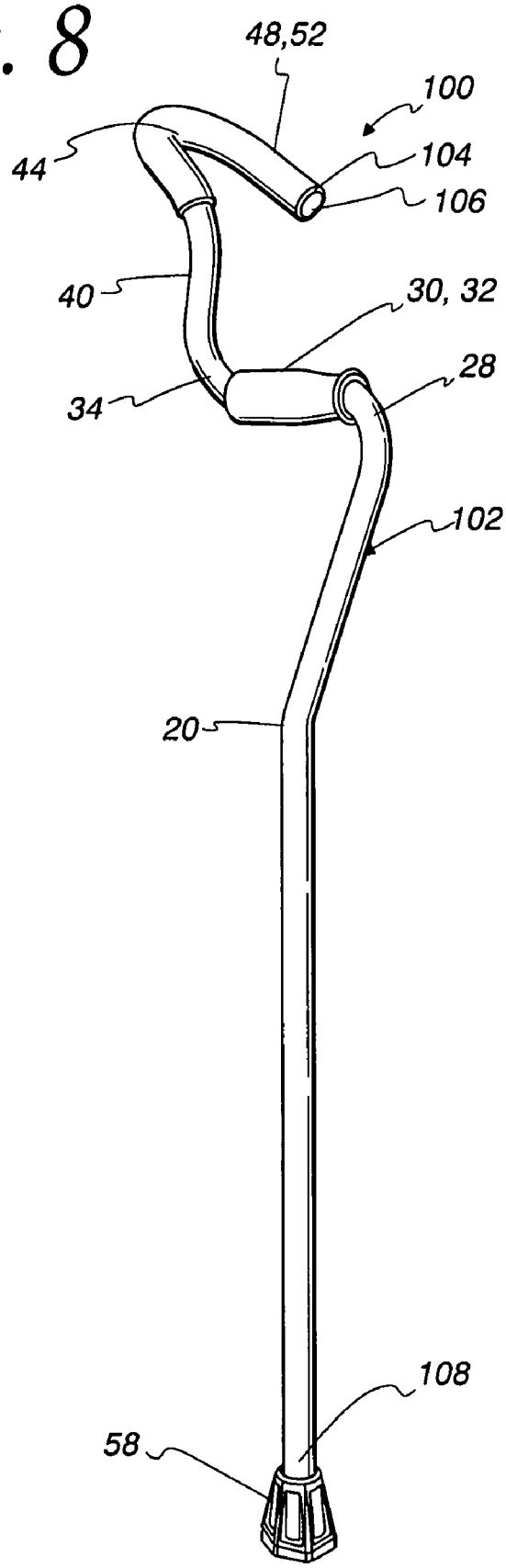
FIG. 8 is a perspective view of another embodiment of a mobility device.
Figure 9:
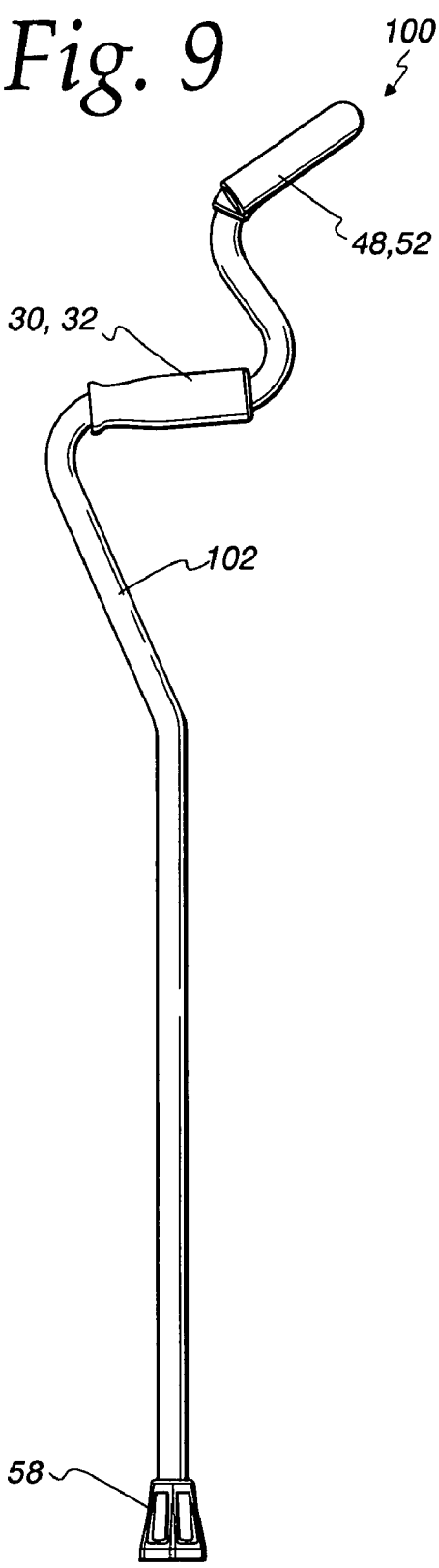
FIG. 9 is a side elevational view thereof, taken from one side.
Figure 10:
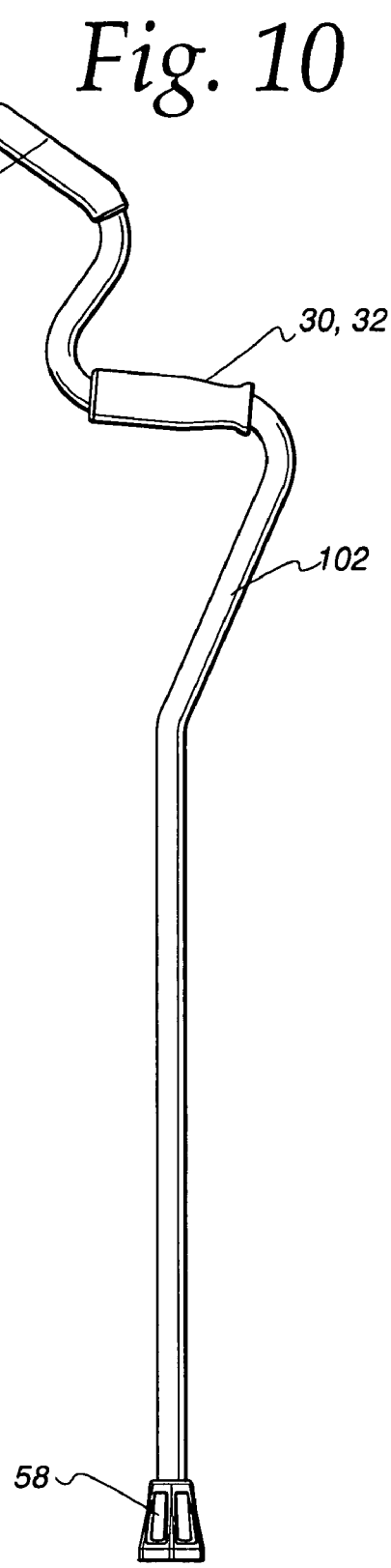
FIG. 10 is a side elevational view thereof taken from an opposite side.
Figure 11:
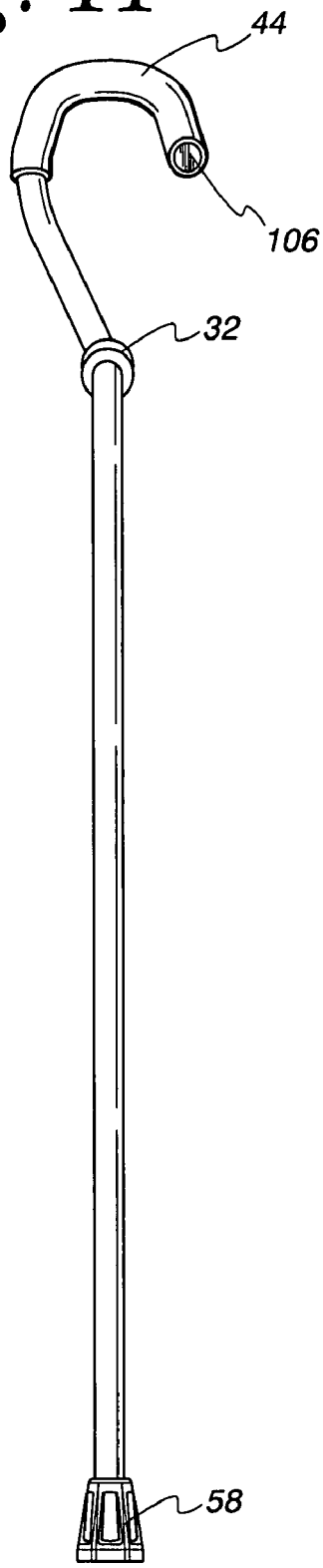
FIG. 11 is a front elevational view thereof.
Figure 12:
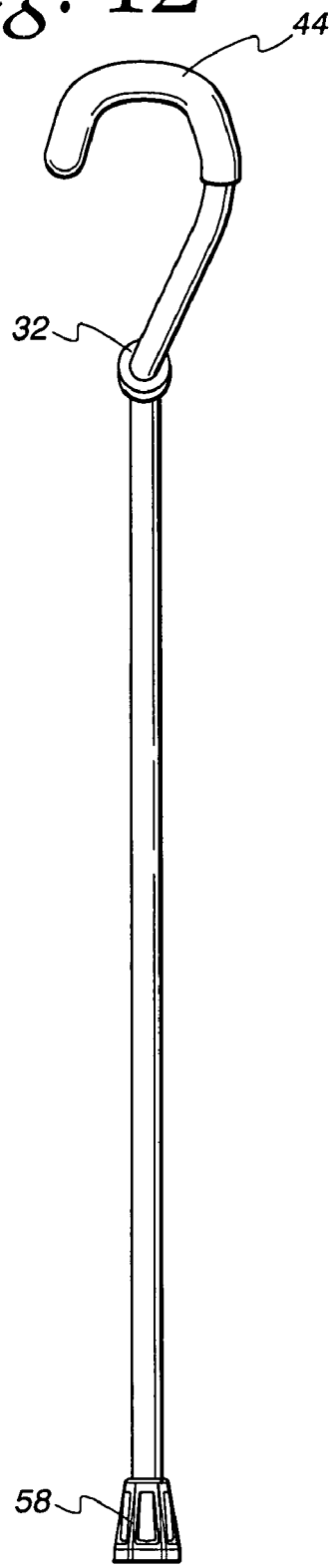
FIG. 12 is a rear elevational view thereof.
Figure 13:
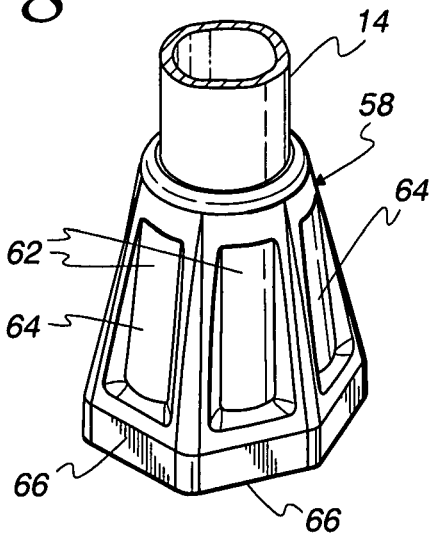
FIG. 13 is a fragmentary view of the mobility device illustrated in FIG. 1 taken on an enlarged scale.

With reference to FIGS. 1 and 6, in use, a user grasps cushion 32, and engages retainer part 48 with his forearm to position his wrist and lower forearm as close as possible in alignment with the central longitudinal axis of lower portion 24 and lower part 14. This alignment allows a user to place the tip 58 with confidence, and to lean against the mobility device with assurance that the support afforded the user will be stable and secure. With the arrangement according to principles of the present invention, the aforementioned stability and secure support are maintained for users in the widest population segment as the users negotiate walking and climbing movements. To further improve lateral support provided for a user's forearm, bend 40 is extended toward handle portion 30.

As will be appreciated by those skilled in the art, it is important that a user continuously feel confident when trusting the mobility device to provide balancing support during movements that would otherwise have compromised a user's balance, leading to a fall or other mishap. It is also important that the "learning curve" for new users be kept as short as possible. Accordingly, it is important that the mobility device is not only strong and well made, but that it also conform to a user's intuition, without requiring special skills, or requiring the user to divert concentration from the task at hand. With the present invention, users, even those seriously debilitated, will experience stability at their forearm, while naturally, or intuitively, grasping the mobility device in a natural posture, even during demanding movements such as walking over uneven terrain or climbing. In particular, arrangements according to principles of the present invention have been found to relieve pressure from a user's wrist, which is otherwise present with other devices. Accordingly, when the user has sufficient control and is not off-balance, the user's forearm is placed in near-coaxial alignment with the lower body part 14.

Moreover, as will be appreciated by experienced users and those skilled in the art, the very act of walking and climbing tends to briefly put the user slightly off-balance for a brief moment during each stride. Contact with a support surface during these moments may tend to displace the user's forearm from the desired precise coaxial alignment with the lower body part of the mobility device. Accordingly, there is provided in the mobility device, an "upper stabilizing structure" comprising the third bend 34, the intermediate portion 36 including bend 40, and the forearm-retaining portion including bend 44. The stabilizing structure limits excursion of the user's forearm to only a slight deviation away from the desired near-coaxial alignment, ensuring that the user's forearm is maintained at an optimum alignment with the lower portion of the mobility device.

With mobility devices according to principles of the present invention, support, stability and control are readily and intuitively achieved with a relatively short learning period. Accordingly, mobility devices according to principles of the present invention provide multiple points of support for various body parts, which when combined, allow the mobility device to feel like a solid extension of the arm, with the lower body part being intuitively perceived as being in line with the user's forearm. With other types of mobility devices, considerable fatigue has been experienced when the user's wrists assume a "non-neutral" position. With the present invention, not only is such fatiguing eliminated, but even users with small features find the reliable support offered by the mobility device of the present invention to be readily achieved without undue strain on various body parts. With the present invention, comfort is readily achieved even for users who must assume otherwise difficult stances, such as standing relatively still for long periods of time.

Referring now to FIGS. 8-12, an alternative mobility device is generally indicated at 100. Included is a tubular body 102 which is preferably continuous throughout, between an upper end 104 which is closed by an end cap 106 and a lower end 108 which is enclosed by end member 58. As with the preceding mobility device 10, handle portion 30 is covered by a hand grip cushion 32 and retainer portion 48 is covered by cushion 52. Mobility device 100 is also provided with five bends including a first bend 20, a second bend 28 and a third bend 34 formed between the handle portion 30 and an intermediate portion which includes a fourth bend 40. A fifth bend 44 forms the generally U-shaped receptacle or retainer portion 48. Preferably, the portion of tubular body 102 between first bend 20 and lower end 108 is continuous and unbroken, in contrast to the lower construction of mobility device 10, described above. Thus, mobility device 100 may be described as having a fixed length. In practice, the lower end of mobility device 100 can be cut to a desired length before applying end member 58.

Figure 22:
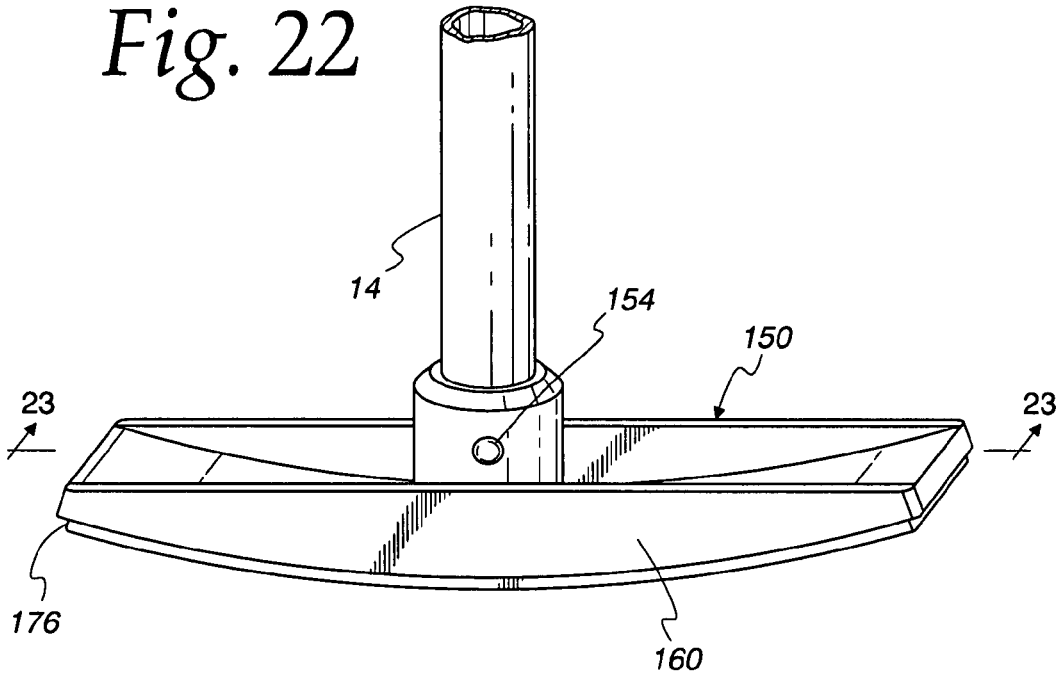
FIG. 22 is a perspective view of an end member for a mobility device.
Figure 23:
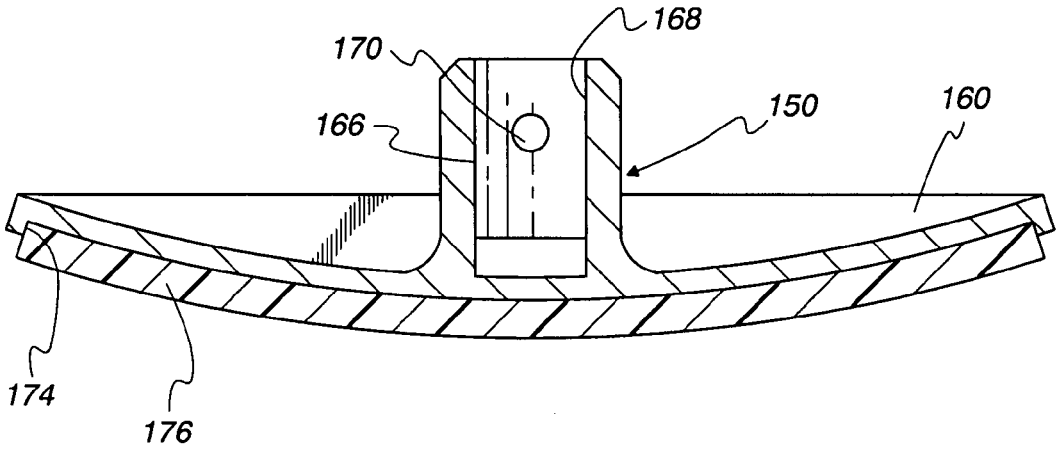
FIG. 23 is a cross-sectional view taken along the line 23-23 of FIG. 22.

Turning now to FIGS. 22-25, an alternative rocker-type end member or end piece is generally indicated at 150. As can be seen for example in FIG. 22, end member 150 is mounted to the lower end of tubular body 14. Preferably, end member 150 is secured to tubular body 14 by a rivet 154 (shown in FIG. 22), although a threaded fastener or other conventional fastener could be employed, if desired. With additional reference to FIG. 23, end member 150 includes a rigid body 160 formed of a rigid material such as plastic, aluminum, or other material suitable for reliably bearing a user's weight. Housing 160 is rounded so as to have a downwardly facing convex shape. Preferably, housing 160 is formed to have a generally arcuate shape, although other shapes such as eliptical, could be used, if desired. With reference to FIG. 23, housing 160 includes an upwardly extending mounting portion 166 defining an internal passageway 168 for receiving tubular body 14. In the preferred embodiment, passageway 168 is generally cylindrical, although other shapes can be used as well, preferably conforming to the shape of the lower portion of the tubular body to which it is connected. A hole 170 is provided to receive a fastener for securement to the tubular body.

Housing body 160, as mentioned, is generally rounded so as to present a downwardly facing convex shape. Preferably, the underside of body 160 defines a generally rounded and preferably arcuate recess 174 for receiving the upper part of a pad 176. Pad 176 is secured to body 160 with a suitable adhesive, although rivets or other fastening devices could be employed, if desired. Pad 176 is preferably made of a suitable gripping material such as a rubber or plastic compound, so as to provide the user with an assured grip to the pavement or floor surface. As indicated in FIG. 23, pad 176 has a generally constant thickness throughout, although a variable thickness could be employed, if desired. Further, pad 176 is preferably continuous throughout, although the bottom floor engaging surface of the pad could have a series of multiple protrusions, if desired.

As can be seen, for example, in FIG. 22, it is preferred that the connection to body part 14 in this embodiment is centered length-wise (as well as width-wise) on the housing part 160. Further, it is generally preferred that pad 176, although curved, be relatively flat such that transverse cross sections taken through pad 176 comprise generally straight lines. If desired, the housing and pad could be curved in one or more additional planes so as to take on a generally curved transverse cross-sectional shape.

Figure 24:
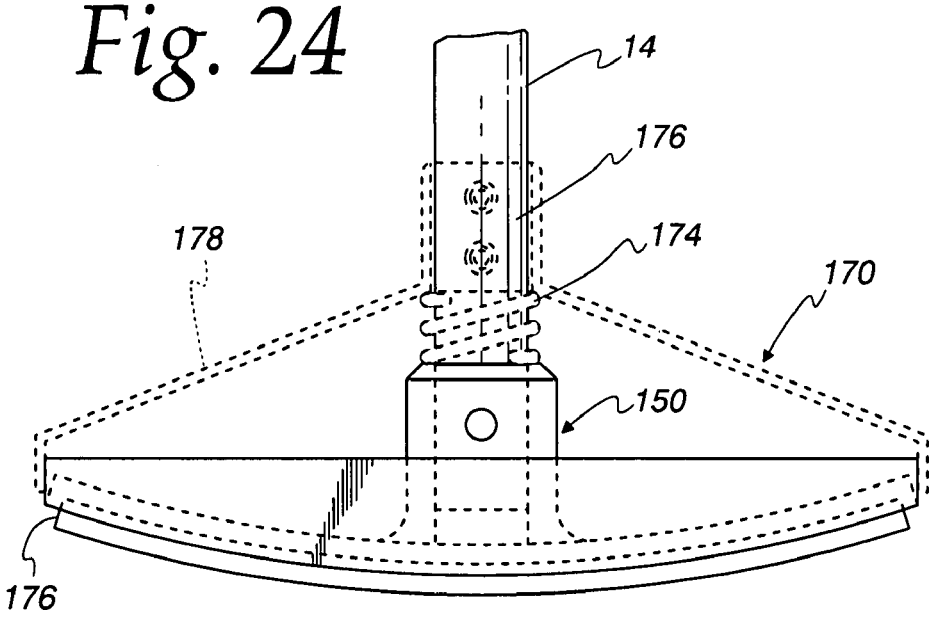
FIG. 24 is a cross-sectional view similar to that of FIG. 23 but showing additional components forming an end member assembly.

Turning now to FIG. 24, an end assembly 170 is formed using end member 150 which is slidably secured to the bottom end portion of tubular body 14, with rivet 154 of FIG. 22 being omitted. End member 150 is secured to a coil spring 174 and a mounting collar 176 which joins an upper housing 178 to the bottom end of tubular body 14. In use, downward force is applied through tubular body 14 to upper body 78 and to coil spring 174. With contact to a floor surface, end member 150 causes spring 174 to compress in response to the downward loading, to provide a shock absorbing action. As with the preceding embodiment shown in FIGS. 22 and 23, the rounded pad 176 contacts the ground with a rocking action, providing continuous contact with the ground over the exposed surface of the pad, to provide a prolonged ground engaging support as a user walks across the support surface. With the arrangement of FIG. 22, downward force is fully transmitted through pad 176 to the ground, whereas with the arrangement of FIG. 24, part of the downward force compresses spring 174, while the remaining portion is transmitted to the ground surface. Alternatively, pad 176 could be fixed to the bottom end of the tubular body 14 and the housing 178, equipped with gripping teeth (not shown) on its bottom end, could be made to slide past the pad 176 to engage an icy surface, for example. Thereafter, housing 178 would return to its upper rest position, under force of spring 174.

Figure 25:
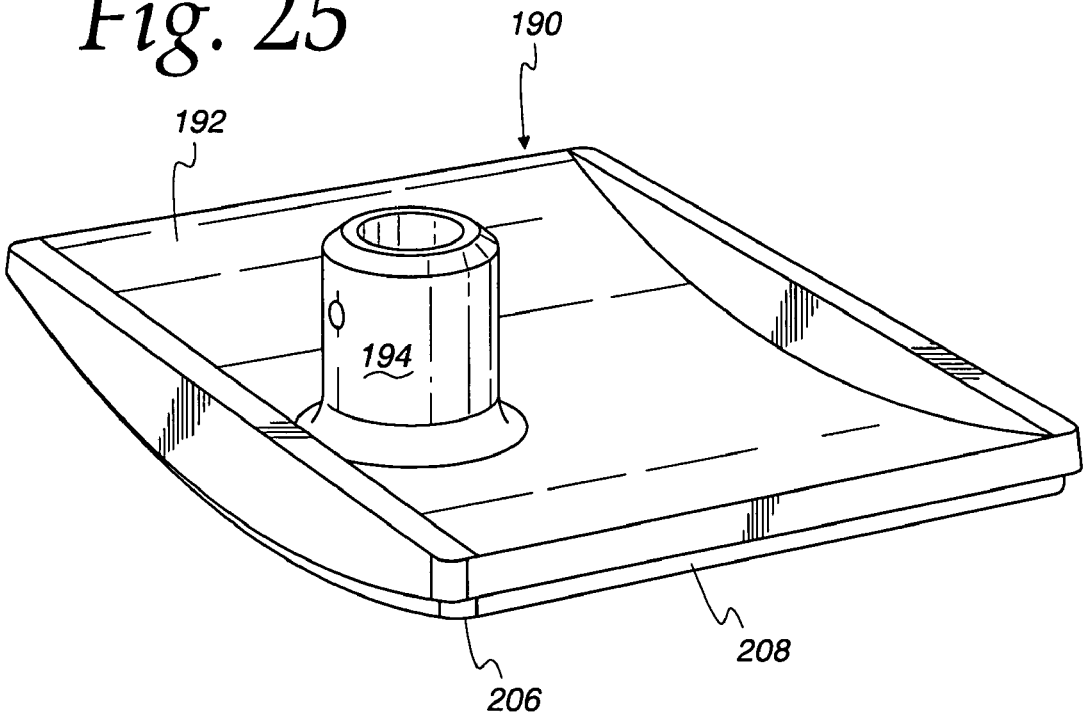
FIG. 25 is a perspective view of another end member.

Turning now to FIG. 25, an alternative arrangement of an end member, generally indicated at 190, includes an upper rigid housing 192 and an upstanding connecting portion 194 which, in the preferred embodiment, has a generally cylindrical shape and defines a generally cylindrical passageway for receiving the tubular body 14. A generally arcuate or rounded pad 206 is secured to the bottom surface of housing 190. Preferably, the bottom surface of housing 190 is rounded and forms a recess for receiving the upper portion of pad 206, in the manner described above with reference to FIG. 23. The upstanding support portion 194 is preferably laterally offset, located adjacent one side of pad 206 (such as the inboard side located closest to the user's body, e.g. the left side as shown in FIG. 25). Preferably, upstanding portion 194 is centered lengthwise.

The foregoing description and the accompanying drawings are illustrative of the present invention. Still other variations in arrangements of parts are possible without departing from the spirit and scope of this invention.

What is claimed is:

1. A mobility device for providing ambulatory support for a user, comprising:

a tubular body having an upper part and a lower part, the upper part having at least five spaced-apart bends and terminating in a free end;

a U-shaped forearm engaging portion adjacent the free end comprising one of said bends;

a manually graspable handle portion disposed between two of said bends, an anterior bend curving downward toward the lower part and a posterior bend curving upward toward the free end, the handle portion defining a vertical plane that includes an axis of the user's forearm when the user's hand grasps the handle portion and the user's forearm is placed in the U-shaped forearm engaging portion;

a generally S-shaped intermediate portion extending from the posterior bend between the handle portion and the U-shaped forearm engaging portion; and the lower part defining an axis extending substantially in the vertical plane and including a floor-engaging free end.

2. The device of claim 1 wherein at least three of the five bends support and guide the forearm of the user, limiting excursion of the user's forearm away from the vertical plane, so as to maintain approximate alignment of the axis with the vertical plane.

3. The device of claim 1 wherein the upper and the lower parts are movable toward and away from one another.

4. The device of claim 1 wherein the upper part is telescopically movable with respect to the lower part.

5. The device of claim 4 further wherein the first and the second interengaging parts cooperate to define a detent for selectable adjustable positioning of one part inside the other.

6. The device of claim 1 wherein each of the five bends is a single plane bend.

7. The device of claim 1 further comprising a rocker member at the floor-engaging free end, having a convex downwardly facing surface.

8. The device of claim 7 wherein the rocker member is slidably mounted to the floor-engaging free end.

9. The device of claim 1 wherein:

the U-shaped forearm engaging portion is downward slanting with the one of said bends disposed between a pair of legs, with each of the legs being substantially similar in length.

10. A mobility device for providing ambulatory support for a user, comprising:

a tubular body having an upper part interengaged with a lower part, the lower part defining an axis and the upper part having at least five spaced-apart bends and terminating in a free end;

a manually graspable handle portion disposed between two of said bends, an anterior bend curving downward toward the lower part and a posterior bend curving upward toward the free end;

a downward slanting U-shaped forearm engaging portion adjacent the free end comprising one of said bends disposed between a pair of legs, with each of the legs being substantially similar in length; and an intermediate portion extending from the posterior bend between the handle portion and the U-shaped forearm engaging portion;

wherein the manually graspable handle portion is disposed above, and intersecting the axis of the lower part.

11. The device of claim 10 wherein the device is configured to be used interchangeably, without modification, in either of the user's right and left arms.

12. The device of claim 10 wherein at least three of the five bends support and guide the forearm of the user, limiting excursion of the user's forearm away from the axis of the lower part, so as to maintain approximate alignment therewith.

13. The device of claim 10 wherein the upper and the lower parts are movable toward and away from one another.

14. The device of claim 10 wherein the upper part is telescopically movable with respect to the lower part.

15. The device of claim 10 further comprising a rocker member at the floor-engaging free end, having a convex downwardly facing surface.

16. The device of claim 10 wherein the rocker member is slidably mounted to the floor-engaging free end.

17. A mobility device for providing ambulatory support for a user, comprising:

a tubular body having an upper part and a lower part;

the upper part having at least five bends defining a vertical plane and terminating in a free end, the lower part defining an axis in the vertical plane;

the upper part comprising a downward slanting U-shaped forearm engaging portion adjacent the free end, the U-shaped forearm engaging portion comprising one of the bends disposed between a pair of legs, the legs being substantially similar in length;

the bends cooperating to orient an axis of the user's forearm in substantial alignment with the vertical plane; and the lower part having a floor-engaging free end.

18. The device of claim 17 wherein the upper part and the lower part are telescopically engageable one in the other.

19. The device of claim 17 wherein the upper and the lower parts form portions of a one-piece monolithic body member.

20. The device of claim 17 further comprising a rocker member at the floor-engaging free end, having a convex downwardly facing surface.

21. The device of claim 20 wherein the rocker member is slidably mounted to the floor-engaging free end.

22. A mobility device for providing ambulatory support for a user, comprising:

a tubular body having an upper part and a lower part, the upper part having at least four spaced-apart bends and terminating in a free end;

a U-shaped forearm engaging portion adjacent the free end comprising one of said bends;

a manually graspable handle portion disposed between two of said bends, an anterior bend curving downward toward the lower part and a posterior bend curving upward toward the free end, the handle portion defining a vertical plane that includes an axis of the user's forearm when the user's hand grasps the handle portion and the user's forearm is placed in the U-shaped forearm engaging portion;

a generally S-shaped intermediate portion extending from the posterior bend between the handle portion and the U-shaped forearm engaging portion; and the lower part defining an axis extending substantially in the vertical plane and including a floor-engaging free end.

23. The device of claim 22 wherein at least three of the four bends support and guide the forearm of the user, limiting excursion of the user's forearm away from the vertical plane, so as to maintain approximate alignment of the axis with the vertical plane.

24. The device of claim 22 wherein the upper and the lower parts are movable toward and away from one another.

25. The device of claim 22 wherein the upper part is telescopically movable with respect to the lower part.

26. The device of claim 25 further wherein the first and the second interengaging parts cooperate to define a detent for selectable adjustable positioning of one part inside the other.

27. The device of claim 22 wherein each of the four bends is a single plane bend.

28. The device of claim 22 further comprising a rocker member at the floor-engaging free end, having a convex downwardly facing surface.

29. The device of claim 22 wherein the rocker member is slidably mounted to the floor-engaging free end.

* * * * *